US010968722B2

(12) United States Patent
Buckland et al.

(10) Patent No.: US 10,968,722 B2
(45) Date of Patent: Apr. 6, 2021

(54) VALVE ASSEMBLY AND METHOD OF CONTROLLING FLUID FLOW IN AN OIL, GAS OR WATER WELL

(71) Applicant: M-I DRILLING FLUIDS UK LTD, Aberdeen (GB)

(72) Inventors: Jonathan Peter Buckland, Aberdeenshire (GB); James Edward Atkins, Aberdeenshire (GB)

(73) Assignee: M-I Drilling Fluids UK Limited, Aberdeen (GB)

( * ) Notice: Subject to any disclaimer, the term of this patent is extended or adjusted under 35 U.S.C. 154(b) by 151 days.

(21) Appl. No.: 16/348,854

(22) PCT Filed: Nov. 3, 2017

(86) PCT No.: PCT/GB2017/053319
§ 371 (c)(1),
(2) Date: May 9, 2019

(87) PCT Pub. No.: WO2018/087521
PCT Pub. Date: May 17, 2018

(65) Prior Publication Data

US 2020/0190945 A1 Jun. 18, 2020

(30) Foreign Application Priority Data

Nov. 11, 2016 (GB) ..... 1619087

(51) Int. Cl.
*E21B 34/14* (2006.01)
*E21B 21/10* (2006.01)
(Continued)

(52) U.S. Cl.
CPC ..... *E21B 34/14* (2013.01); *E21B 21/103* (2013.01); *E21B 23/006* (2013.01); *E21B 34/10* (2013.01);
(Continued)

(58) Field of Classification Search
CPC ..... E21B 34/14; E21B 2220/06
See application file for complete search history.

(56) References Cited

U.S. PATENT DOCUMENTS 2,117,534 A * 5/1938 Baker ..... E21B 21/10 166/194
4,381,822 A * 5/1983 Fisher, Jr. ..... E21B 34/06 166/326

(Continued)

FOREIGN PATENT DOCUMENTS

CN 104847325 A 8/2015
WO 2016/145540 A1 9/2016

OTHER PUBLICATIONS

Combined Search and Examination Report for the equivalent UK patent application No. GB1619087.8 dated Apr. 6, 2017.

(Continued)

*Primary Examiner* — Kipp C Wallace

(57) ABSTRACT

A valve assembly (1) for use particularly in a deviated wellbore of an oil, gas or water well comprises a body (50) with an axis and first and second resiliently deformable seats (20, 25) to seat a valve closure member (10*a*) such as a ball, the seats being deformable to allow passage of the ball at different first and second fluid pressures acting on the seated valve closure member. The first and second seats are axially spaced from one another on a control sleeve (60) on opposite sides of an inner end of a selectively operable fluid outlet conduit connecting the bore with an external surface of the valve assembly, and operation of the valve assembly at pressures between the first and second pressures opens and closes the outlet while maintaining the ball between the first and second seats.

26 Claims, 7 Drawing Sheets

(51) Int. Cl.
*E21B 23/00* (2006.01)
*E21B 34/10* (2006.01)

(52) U.S. Cl.
CPC ..... *E21B 2200/04* (2020.05); *E21B 2200/06* (2020.05)

(56) References Cited

U.S. PATENT DOCUMENTS 6,253,861 B1 7/2001 Carmichael et al.
2006/0219441 A1 10/2006 Telfer
2008/0093080 A1* 4/2008 Palmer ..... E21B 34/14 166/318
2011/0036592 A1* 2/2011 Fay ..... E21B 34/14 166/374
2011/0278017 A1* 11/2011 Themig ..... E21B 34/14 166/373
2012/0168163 A1* 7/2012 Bertoja ..... E21B 23/04 166/297
2013/0153220 A1* 6/2013 Carter ..... E21B 34/14 166/285
2013/0291962 A1 11/2013 Telfer
2014/0014340 A1* 1/2014 King ..... E21B 43/26 166/285
2014/0246209 A1* 9/2014 Themig ..... E21B 33/124 166/374
2015/0000920 A1* 1/2015 Harris ..... E21B 23/004 166/308.1
2015/0167424 A1* 6/2015 Richards ..... E21B 33/13 166/386
2016/0362962 A1* 12/2016 Gonzalez ..... E21B 34/063
2019/0071953 A1* 3/2019 Saraya ..... E21B 43/26

OTHER PUBLICATIONS

International Search Report and Written Opinion for the equivalent International patent application PCT/GB2017/053319 dated Feb. 7, 2017.

* cited by examiner

VALVE ASSEMBLY AND METHOD OF CONTROLLING FLUID FLOW IN AN OIL, GAS OR WATER WELL

The present application claims the benefit of and claims priority from GB patent application 1619087.8 filed Nov. 11, 2016, and relates to a valve assembly and a method of controlling fluid flow in an oil, gas or water well.

BACKGROUND

Circulation tools employ plugs released into the bore of a tubular of an oil, gas or water well which then temporarily seals the bore. The resulting build-up of fluid pressure is, in some cases, then utilised to actuate a tool further downhole, or alternatively to create jets of fluid into the annulus for cleaning or similar purposes.

In many cases the plug is released under gravity into the tubular and carried downhole under the flow of fluid from the surface, coming to rest on the valve seat below. Often the plug is deformable to provide a better seal between the plug and the seat. This deformation further allows for the plug to be forced through the valve seat in order to clear the central bore of the tubular and permit, for example, wireline tools to be passed through. Wellbore operations in horizontal wells generally cannot use dropped balls to activate tools, as the ball can become unseated from the tool in deviated and horizontal wellbores.

SUMMARY

A valve assembly for use in a wellbore of an oil, gas or water well, the valve assembly having a body with a bore for flow of fluid through the valve assembly, the bore having an axis, the assembly having first and second resiliently deformable seats axially spaced from one other in the bore and each adapted to seat a valve closure member in the bore, to resist the passage of fluid through the bore past the seated valve closure member, wherein the first seat is adapted to resiliently deform from a first resting configuration to a second deformed configuration of the first seat to allow passage of the valve closure member past the first seat at a first threshold pressure of fluid acting on the valve closure member seated on the first seat, and wherein the second seat is adapted to resiliently deform from a first resting configuration to a second deformed configuration of the second seat to allow passage of the valve closure member past the second seat at a second threshold pressure of fluid acting on the valve closure member seated on the second seat, wherein the second threshold pressure is higher than the first threshold pressure, and wherein the first and second seats are axially spaced from one another along the axis of the bore on opposite sides of an inner end of a selectively operable fluid outlet conduit connecting the bore with an external surface of the valve assembly.

The different threshold pressures at which the first and second seats allow passage of the valve closure member has the advantage that the first seat can admit the valve closure member into the space between the two seats at a relatively low pressure without changing the activation status of the valve assembly, and therefore without functioning the tool. The movement of the valve closure member is then restricted between the two seats and the valve assembly can then be used in different orientations, for example, in horizontal wellbores, without the valve closure member escaping from the assembly. The second seat permits the valve assembly to activate under the higher pressure at the second pressure threshold.

The fluid outlet conduit is optionally selectively operable to open and close the conduit. The fluid outlet conduit is optionally in communication with the bore.

The valve closure member optionally moves through the valve seat when subjected to fluid pressure differentials across the valve seat.

Optionally seating of the valve closure member on one or both of the first and second seats closes the bore and prevents axial flow of fluid through the bore past the valve closure member on the seat. Optionally at the activation pressure, the valve closure member stays seated on the second seat. Optionally each seat circumferentially surrounds the valve closure member during deformation of the seat, optionally maintaining a fluid-tight seal denying fluid passage between the seats and the valve closure member when the valve closure member is seated, and optionally during the deformation of each seat. Optionally each seat is annular, having an inner diameter and an outer diameter which are optionally circular. Each inner diameter optionally provides a restriction in the bore at an apex of the respective first and second seats. The apexes of the first and second seats are optionally axially spaced apart by a distance greater than the inner diameter at the apex of at least one of the first and second seats. Each apex optionally forms the narrowest part of the seat and optionally of the bore. Optionally the valve closure member moves through the annular seats during deformation. The seats are optionally each radially compressible, with an inner diameter (ID):outer diameter (OD) ratio which increases as the closure member passes through each seat. Optionally the first seat is disposed above the second seat in the wellbore, i.e. closer to the entry of the wellbore into the formation in which it is drilled, for example, closer to the wellhead at the surface or the seabed, and optionally the second seat has a higher elastic modulus than the first seat. The well can be an offshore or onshore well.

Optionally the apex of the first seat can be cylindrical, with an axial component of substantially constant ID, which can optionally extend along the axis of the bore without substantially deviating in ID. Optionally the apex of the second seat is arcuate, coming to a point of minimum ID with substantially no or little axial component.

Optionally the ID of the first seat is smaller than the OD of each of the valve closure members. Optionally the OD of the first valve closure member is larger than the OD of the second valve closure member. Optionally the ID of the second seat is smaller than the OD of the first valve closure member but larger than the OD of the second valve closure member, allowing easier passage of the second valve closure member than the first through the second seat.

Optionally when the first valve closure member is seated on the second seat, and the first valve closure member is seated on the first seat, the seated first valve closure member engages and optionally supports the seated second valve closure member and resists its movement through the first seat. The movement of each of the valve closure members is thus optionally controlled by the movement of the first valve closure member through the second seat.

Optionally the valve assembly has a closure member catcher device adapted to catch and retain valve closure members that have passed through the seats.

Optionally in each seat, the first resting configuration is the resting configuration in the absence of any forces applied to the seat. Each seat optionally maintains a consistent outer radial dimension in both of the first and second configurations, and during deformation. Optionally each seat is formed from a resilient material such that the inner radial dimension of each seat optionally expands, optionally circumferentially during deformation and axial passage of the valve closure member through the seat, such that the radial thickness and optionally the volume of the seat reduces transiently during deformation, and optionally such that the outer diameter of the seat does not change during deformation. The inner diameter and radial thickness (and optionally the volume) of the first and second seats optionally recover resiliently to the first configuration after axial passage of the valve closure member through the seat. The first and second seats optionally extend radially inward from the inner surface of the bore.

Optionally the deformation of the seat is an elastic deformation within the elastic limits of the seat, which resiliently returns to its first configuration with its original inner and outer diameter after passage of the valve closure member through the seat. Optionally the first seat is disposed upstream from or above the second seat (by which we mean closer to the surface or other insertion point of the valve assembly into the well), and the second seat has a higher elastic modulus than the first seat. The second seat can simply have a larger mass than the first and can be made of the same material, but in a stiffer structure less susceptible to deformation. Alternatively the second seat can be made from a stiffer material than the first.

Optionally each of the first and second seats extends radially inward from the inner surface of the bore. Optionally the seats have different IDs and different ODs. Optionally the first seat has a narrower ID and a narrower OD than the second seat. Optionally each seat is integrally formed from resilient material.

Optionally the body forms part of the wellbore conduit and is optionally connected by threaded connections to the wellbore conduit, optionally at each of the uphole and downhole ends. Optionally the axis of the valve assembly body is coaxial with the axis of the wellbore.

The body optionally has at least one outlet port adapted to be actuated between open and closed configurations to permit and restrict fluid communication between the bore and an external surface of the valve assembly, for example, an annulus between the external surface of the assembly and the inner surface of a wellbore conduit of an oil or gas well. Optionally the outlet port extends radially through a wall of the body. Optionally the outlet port is selectively obturated by a control sleeve which is movable axially relative to the outlet port to open and close it. Optionally the control sleeve is axially movable within the bore relative to an outlet port provided in the body between open and closed configurations of the control sleeve to open and close fluid communication between the outlet port and the bore. Optionally the outlet port can slide axially within the bore, but in certain embodiments the outlet port remains static with respect to the bore and the control sleeve is a sliding sleeve which slides axially relative to the outlet port to open and close it. Optionally the control sleeve has an aperture which is adapted to move at least partially within the bore to control fluid communication between the bore and the outlet port. Thus the movement of the control sleeve relative to the outlet port is optionally adapted to increase and/or decrease the degree of alignment of the outlet with the aperture on the control sleeve as the control sleeve moves relative to the outlet port. The degree of alignment between the aperture and the outlet can vary such that in some configurations, the outlet can be partially open (i.e. partially aligned with the aperture on the control sleeve) and in others it can be fully open (fully aligned with the aperture on the control sleeve). Optionally the control sleeve has seals (optionally annular seals above and below the aperture on the control sleeve) which seal off the outlet port from the bore when the control sleeve and outlet port are in the closed configuration. Optionally, the valve seat is provided in the control member, i.e. on the control sleeve.

Optionally the valve assembly comprises an outlet sleeve, which can be fixed relative to the outlet port, and which can include an outlet aperture in fluid communication (and optionally aligned) with an inner end of the outlet port in the body, whereby fluid passing through the outlet sleeve passes through the outlet aperture therein, and thereafter through the outlet port, optionally flowing into the annulus outside the body. The outlet sleeve is optionally fixed within the bore of the body in a replaceable manner, and can be removed and replaced in the event of erosion of the aperture in the outlet sleeve. The outlet port is optionally sealed, optionally by resilient seals compressed between the outlet sleeve and outlet port. Optionally, the control sleeve is received within the bore of the outlet sleeve, and slides axially relative to the static outlet sleeve, which remains stationary relative to the outlet port.

Optionally more than one outlet port can be provided in the body, and more than one corresponding aperture can be provided in the outlet sleeve and control sleeve. Optionally the outlet port can be directed in a non-perpendicular direction with respect to the axis of the bore, to direct the jet of the outlet in a particular manner, for example, downwards in the annulus.

Optionally the outlet sleeve is fixed in position by at least two fixing members. Optionally the fixing members are inserted radially inwards through the wall of the body and into receiving holes in the outlet sleeve, thereby securing the outlet sleeve in position in the body. Optionally the at least two fixing members are disposed on circumferentially opposing sides of the outlet sleeve. Optionally the fixing members are threaded. Optionally the outlet sleeve is restrained from both rotational and axial movement, optionally relative to the body, and optionally relative to the other components of the valve assembly.

Optionally in the closed configuration, the outlet port through the valve assembly body is closed off from the bore by the control sleeve, and all fluid flows through the central bore of the valve assembly, optionally unimpeded by a valve closure member. Optionally in the closed configuration fluid is prevented from flowing along the outer surface of the control sleeve, between the control sleeve and the outlet sleeve and into the radial ports by at least one circumferential seal, optionally more than one seal. Optionally the seals are annular seals. Optionally the seals are resilient seals, such as o-rings. Optionally the seals are metal-to-metal seals.

Optionally the valve assembly comprises a resilient device. Optionally the resilient device comprises a compression spring. Optionally the resilient device can be one of a coil spring; a Belleville spring; a wave spring, without excluding any other resilient device. Optionally the resilient device biases the valve assembly towards a closed configuration. Optionally the resilient device circumferentially surrounds at least a portion of the control sleeve and urges it axially within the bore. Optionally the control sleeve is biased resiliently against the direction of fluid flow through the bore of the assembly by the resilient device. Optionally the control sleeve is biased into the closed configuration and the biasing force (e.g. of the resilient device) is optionally chosen such that fluid pressure above the seated valve closure member at the first threshold pressure is insufficient to move the control sleeve from the closed configuration. Optionally fluid pressure above the seated valve closure member between the first and second threshold pressures causes the control sleeve to move from the closed configuration to the open configuration.

Optionally the resilient device is axially restrained at its uphole end by a circumferential shoulder or other portion of the control sleeve. Optionally the resilient device is held in compression within the bore of the body between an upwardly facing lower shoulder fixed in the bore of the body at a downhole or downstream end of the resilient device and a portion of the control sleeve at the upper or upstream end of the resilient device. Optionally the resilient device can engage against a spring retainer at either end of the resilient device, which can optionally engage the lower shoulder and the control sleeve. The spring retainer optionally circumferentially surrounds a portion of the control sleeve. Optionally the spring retainer centralises the control sleeve within the bore.

The control sleeve can optionally comprise a single sleeve, or an assembly of sleeves connected together to move together as a control sleeve assembly. The different features of the control sleeve can be provided on one or more of the assembly of sleeves in the control sleeve assembly.

In one example, the control sleeve can be fixed rotationally in the bore such that it moves axially with respect to the outlet port, but does not rotate relative to the outlet port.

Optionally the valve closure member comprises a ball, but could also comprise a dart, a bar or any other plugging device which can travel by gravity or with fluid flow through the bore to engage the seat and obturate fluid flow through the bore. Optionally the valve closure member has a generally spherical structure, and/or optionally a generally consistent sealing diameter to engage with the seat regardless of the orientation of the valve closure member. Optionally the valve closure member is non-deformable at the pressures used for the operation of the various examples, but could be deformable or at least partially comprised of a deformable material. Optionally there are two valve closure members. Optionally each valve closure member has the same sealing diameter. Optionally a first valve closure member has a larger diameter than a second valve closure member. Optionally the second valve closure member has an outer diameter adapted to pass through the seats without seating the second valve closure member in the valve as firmly as the first valve closure member. Optionally the OD of the second valve closure member is smaller than the ID of the second seat in its resting configuration (and hence it is adapted to pass through the second seat without seating) but larger than the ID of the first seat in its resting configuration, and hence is arrested by the first seat in the absence of a pressure differential across it.

Optionally each of the seats extends radially inwards from the inner surface of the control sleeve, creating a throat in the seat, which is narrower than both the ID of the bore of the control member and the OD of the valve closure member.

Optionally the seating of the valve closure member in the first or the second seat leads to a build-up of fluid pressure uphole of the valve assembly as fluid continues to flow into the valve assembly from above. Optionally the pressure acts in a downhole direction on the uphole surface of the valve closure member and on the seat. Optionally, above the first threshold pressure but below the second, the fluid pressure differential across the seated valve closure member on the second seat overcomes the biasing force of the resilient device urging the control sleeve in the opposite direction (i.e. upwards) and the control sleeve optionally shifts axially downwards in the bore relative to the outlet port into an open configuration, optionally compressing the resilient device, while retaining the valve closure member in the second seat. Optionally, in this open configuration, the control sleeve seats against a shoulder formed in the bore of the body to limit the axial travel. Optionally the shifting of the control sleeve relative to the outlet port(s) into the open configuration connects the outlet port(s) in the body with the bore, (optionally through the alignment of the apertures in the control sleeve and the outlet sleeve with the outlet port) allowing fluid flow from the bore through the outlet port(s). Although the first seat has deformed to allow passage of the ball through it at the first threshold pressure, the second seat below it has a higher shear force, and resists deformation at the first threshold pressure and all pressures below the second threshold pressure, thereby preventing passage of the ball through the second seat. Since the first seat has resiliently recovered its original configuration after passage of the valve closure member, the bore above the seated valve closure member on the second seat is restricted by the recovered first seat, and the valve closure member is then retained between the first and second seats. Thus at the first threshold pressure, and below the second, the valve closure member is retained on the second seat and continues to obturate the bore of the valve assembly, diverting fluid outside the valve assembly. The valve assembly is adapted to release the valve closure member in response to fluid pressure above the seated valve closure member at the second threshold pressure higher than the first threshold pressure. In one example, the control sleeve remains in the open configuration with the outlet port(s) in fluid communication with the bore subject to continued fluid pressure above the seated valve closure member. The force of the resilient device is optionally relatively weak, and the fluid pressure necessary to compress the spring is optionally below the second threshold fluid pressure necessary to deform the seats and drive the seated valve closure member through them. Hence, at pressures between the first and second threshold pressures, the bore is obturated by the valve closure member, which remains in the seat when the valve is in the open configuration.

The valve assembly can be cycled repeatedly between open and closed configurations by increasing and decreasing the pressure above and below that needed to compress the spring, which is well below the second threshold pressure needed to pass the valve closure device through the second seat. Therefore, the pumps can be switched on and off repeatedly from the surface to open and close the ports, and the fluid can be jetted out of the radial outlet ports to clean the annulus, or perform other circulation tasks, without moving the ball from its position between the first and second seats.

When the valve is to be reset after circulation tasks are complete, optionally closure of the radial ports is achieved by admitting (e.g. dropping) a second, third, or further valve closure member(s) into the bore, e.g. from surface. Optionally the travel of the further valve closure member is halted by the first valve closure member retained in the bore between the first and second seats. The axial spacing between the seats and the radial ports is optionally adapted for the dimensions of the valve closure members, such that when the further valve closure member engages with the valve closure member retained between the seats and seated on the second seat, the further valve closure member seals off or substantially restricts the bore, advantageously at a location uphole of the radial outlet ports, optionally preventing any diversion of fluid flow through the radial outlet ports. Optionally, the choking of fluid flow in the bore leads to a build-up of fluid pressure to a second pressure threshold uphole of the further valve closure member. Optionally this fluid pressure can be further increased from the surface pumps as required. Optionally this increased fluid pressure to e.g. the second pressure threshold acts on the further valve closure member and urges it in a downhole direction. The further valve closure member optionally in turn presses down on the valve closure member retained between the seats. Optionally this results in the downhole valve closure member retained between the seats being forced through the second seat, along with the uphole/further closure member, and the second seat optionally deforms as the valve closure members pass through it. Optionally the valve closure members are then caught in the closure member catching device further downhole.

Optionally the expulsion of all the valve closure members relieves the pressure on the resilient device in the valve assembly and results in the valve assembly returning to its first, closed configuration, with fluid travelling axially through the bore rather than radially through the outlet ports. The removal of the fluid pressure differential across the seats removes the force compressing the spring, which returns the control sleeve to the original configuration.

In one example, the outlet sleeve of the valve assembly comprises a leading edge at its uphole facing end. Optionally this leading edge is formed as a circumferential chamfered shoulder extending radially inwards into the bore. The shoulder optionally has a maximum diameter at its uphole end, and optionally narrows in diameter towards its downhole end, optionally to at least the same internal diameter as the bore of the control sleeve, such that the leading edge forms a funnel, having a throat that narrows to a diameter at its downhole end that is at least as narrow as the inner diameter of the bore of the control sleeve. Optionally the leading edge is formed on a cap, which is optionally threadedly connected to the outlet sleeve.

One effect of the leading edge is to reduce the thrust acting on the moving part of the valve (i.e. the control sleeve) in the downhole direction. The restriction in the inner diameter of the chamfered shoulder acts to reduce the drag forces experienced by the downhole portion of the valve assembly. Pressure experienced by the uphole face of the valve assembly is correspondingly reduced in this arrangement relative to the pressure experienced by the assembly when a leading edge is not formed in the fixed sleeve. Thus the arrangement is less sensitive to accidental actuation without a valve closure member being seated in the bore.

The leading edge increases the velocity of the fluid and correspondingly decreases the fluid pressure, in accordance with Bernoulli's principle.

The present application also discloses a method of diverting fluid flow in a wellbore of an oil, gas, or water well, the method including:

flowing fluid through a valve assembly having a body comprising a bore with an axis, and first and second seats, the bore being in fluid communication with the wellbore, wherein the first seat is adapted to resiliently deform from a first resting configuration to a second deformed configuration of the first seat to allow passage of the valve closure member past the first seat at a first threshold pressure of fluid above the first seat, and wherein the second seat is adapted to resiliently deform from the first resting configuration to a second deformed configuration of the second seat to allow passage of the valve closure member past the second seat at a second threshold pressure of fluid above the second seat, wherein the second threshold pressure is higher than the first threshold pressure;

admitting a valve closure member into the bore of the body and seating the valve closure member on the first seat;

raising fluid pressure above the seated valve closure member on the first seat to the first threshold pressure to move the valve closure member past the first seat and seating the valve closure member on the second seat;

raising the pressure above the seated valve closure member on the second seat to an activation pressure between the first and second threshold pressures and diverting the fluid flowing in the bore through a fluid outlet in communication with the bore and disposed between the first and second seats;

retaining the valve closure member between the first and second seats during activation; and raising the pressure above the seated valve closure member on the second seat to the second threshold pressure to move the seated valve closure member through the second seat to open the bore of the valve assembly.

Optionally the closure of the bore of the valve assembly by the valve closure member actuates the valve assembly from a first configuration (optionally axial flow) to a second configuration (optionally radial flow of fluid through a radial outlet port in a side wall of the valve assembly).

Optionally the valve closure members are dropped down the wellbore, or can be released from above the seat from another location within the well. They fall under gravity or are carried by fluid flow towards the valve seat.

The various optional features of the valve assembly as defined above can be used with the method.

Examples of the present apparatus and method are particularly useful in highly deviated wells, as once seated the ball remains between the first and second seats (optionally seated on the second seat) and is available to obturate the bore regardless of the orientation of the borehole, and regardless of whether or not the pumps have been switched off during any part of the procedure to the force of fluid pressure from uphole. Retention of the seal helps to avoid premature disengagement of a downhole tool, or and improves consistency of cleaning in the annulus in circulation examples.

The various aspects of the apparatus and method disclosed herein can be practiced alone or in combination with one or more of the other aspects, as will be appreciated by those skilled in the relevant arts. The various aspects can optionally be provided in combination with one or more of the optional features of the other aspects of the apparatus and method. Also, optional features described in relation to one aspect can typically be combined alone or together with other features in different aspects. Any subject matter described in this specification can be combined with any other subject matter in the specification to form a novel combination.

Various aspects of the apparatus and method will now be described in detail with reference to the accompanying figures. Still other aspects, features, and advantages of the present apparatus and method are readily apparent from the entire description thereof, including the figures, which illustrates a number of exemplary aspects and implementations. The apparatus and method is also capable of other and different examples and aspects, and its several details can be modified in various respects, all without departing from the spirit and scope of the present disclosure. Accordingly, each example herein should be understood to have broad application, and is meant to illustrate one possible way of carrying out the apparatus and method, without intending to suggest that the scope of this disclosure, including the claims, is limited to that example. Furthermore, the terminology and phraseology used herein is solely used for descriptive purposes and should not be construed as limiting in scope. Language such as "including", "comprising", "having", "containing", or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Thus, throughout the specification and claims unless the context requires otherwise, the word "comprise" or variations thereof such as "comprises" or "comprising" will be understood to imply the inclusion of a stated integer or group of integers but not the exclusion of any other integer or group of integers.

Any discussion of documents, acts, materials, devices, articles and the like is included in the specification solely for the purpose of providing a context for the present disclosure. It is not suggested or represented that any or all of these matters formed part of the prior art base or were common general knowledge in the field relevant to the present disclosure.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa. In this disclosure, the words "typically" or "optionally" are to be understood as being intended to indicate optional or non-essential features of the apparatus and method which are present in certain examples but which can be omitted in others without departing from the scope of the disclosure.

All numerical values in this disclosure are understood as being modified by "about". All singular forms of elements, or any other components described herein are understood to include plural forms thereof and vice versa. References to directional and positional descriptions such as upper and lower and directions e.g. "up", "down" etc. are to be interpreted by a skilled reader in the context of the examples described to refer to the orientation of features shown in the drawings, and are not to be interpreted as limiting the apparatus and method to the literal interpretation of the term, but instead should be as understood by the skilled addressee. In particular, positional references in relation to the well such as "up" and similar terms will be interpreted to refer to a direction toward the point of entry of the borehole into the ground or the seabed, and "down" and similar terms will be interpreted to refer to a direction away from the point of entry, whether the well being referred to is a conventional vertical well or a deviated well.

BRIEF DESCRIPTION OF THE DRAWINGS

In the accompanying drawings.

FIG. 1 shows a close up section view of a valve assembly in a running in (outlet port closed and central bore open) configuration with no valve closure member seated;

FIG. 2 shows the valve assembly of FIG. 1 with a first valve closure member seated on a first valve seat;

FIG. 3 shows the valve assembly of FIG. 1 with the valve closure member passing through the first valve seat under fluid pressure from above it, e.g. from surface pumps;

FIG. 4 shows the valve assembly of FIG. 1 with the valve closure member seating on the second seat;

FIG. 5 shows the valve assembly in a circulating "open" configuration when under fluid pressure from above with the bore occluded by the seated closure member on the second seat, and a radial outlet port through the wall of the body of the valve assembly diverting fluid flow through the wall for circulation tasks;

FIG. 6 shows the valve assembly in the open configuration of FIG. 5 with a further valve closure member approaching the first seat;

FIG. 7 shows the valve assembly in the FIG. 6 configuration, but with the further valve closure member now driven seated on the first seat and engaging the first valve closure member on the second seat;

FIG. 8 shows the final configuration similar to FIG. 1, after both valve closure members are driven through the seats;

DETAILED DESCRIPTION

Figure 1:
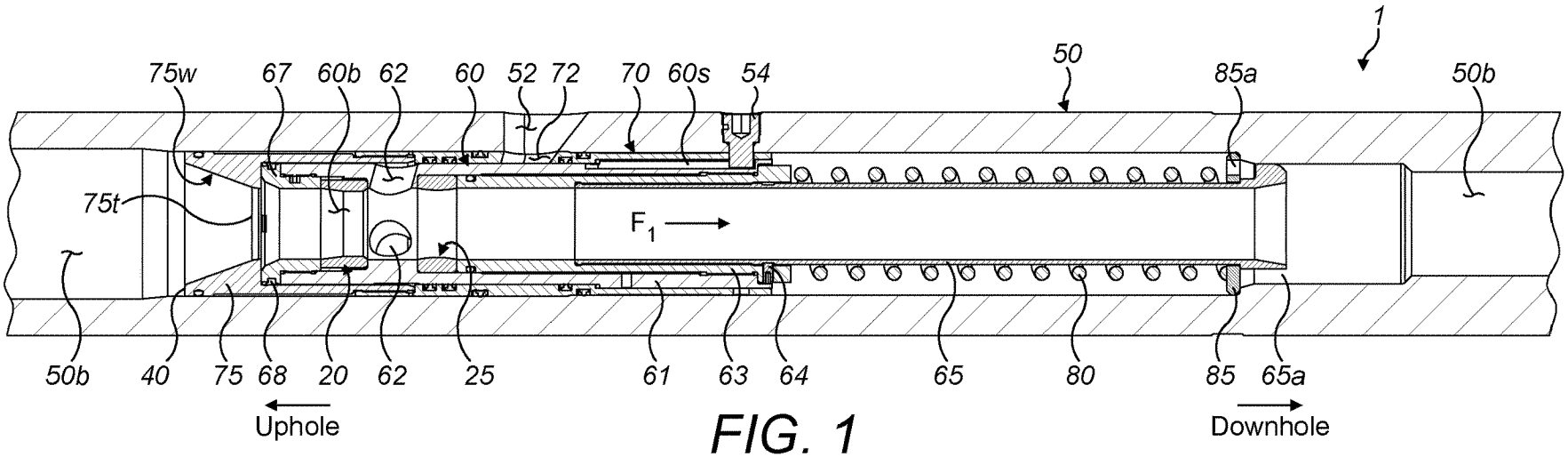
FIGS. 1-8 show a sequence of views showing sequential steps in the operation of one example. In the drawings.

Referring to the drawings, which show an example of a valve assembly 1 for use in a wellbore of an oil, gas or water well, comprises a body 50 which can be in the form of a tubular having box and pin connections or similar, and adapted to be connected into a string of tubulars, for example a drill string, having a drill bit at the lower end (which is the right hand end as shown in the drawings). The body 50 has a bore 50*b* in fluid communication with the bore of the string, and the bore 50*b* houses a number of valve components optionally in the form of sleeves. In this example, the bore 50*b* has an outlet sleeve 70 fixed in the body at an axial location of an outlet port 52, with which it communicates via an aperture 72 aligned with the outlet port 52, and a control sleeve 60. The outlet sleeve 70 surrounds a portion of the control sleeve 60, which has a bore 60*b* with an axis that is generally co-axial with the bore 50*b* of the body and the bore of the outlet sleeve 70. The bores of the sleeves 60, 70 are in fluid communication with the bore 50*b* of the body 50. Seals are provided between the body 50 and outlet sleeve 70 and between the outlet sleeve 70 and the control sleeve 60, above and below the outlet port 52.

The outlet sleeve 70 is fixed in the body 50 in both rotational and axial position by fixing members in the form of pins 54, which are inserted through the wall of the body 50, into receiving bores in the outlet sleeve 70. The pins 54 can be removed in order to facilitate removal and replacement of the outlet sleeve 70 when necessary, for example in the event of erosion of the aperture 72. The pins 54 further extend radially inwards to engage the outer surface of the control sleeve 60, and are adapted to be received in axial slots 60*s* in the outer surface of the control sleeve 60 in the bore of the outlet sleeve 70, to restrict rotational movement of the control sleeve 60 while permitting relative axial movement of the control sleeve 60 within the body 50.

The outlet sleeve 70 provides a replaceable "hanger" in the bore for the connection of the other components, and protects the outlet port 52 from erosion damage by fluid flow through the outlet port 52. The outlet sleeve 70 can be readily removed and replaced when damaged by erosion, or if a different size of inner bore is needed.

A resilient device, in this example in the form of a compression spring 80, circumferentially surrounds a downhole end of the control sleeve 60, and is held in compression to bias the control sleeve 60 upwards in the bore into a first running in configuration as shown in FIG. 1, in which the bore is open and the outlet port 52 is closed. In the first configuration shown in FIG. 1, the spring 80 is energised in compression between an optional spring retainer 85 surrounding the control sleeve 60 at the spring's downhole end and abutting against an upwardly facing shoulder in the bore (optionally formed by a sleeve in the bore), and a downwardly facing shoulder of the control sleeve 60 at its uphole end. The spring 80 is optionally preloaded in compression in the FIG. 1 state, and its expansion urges the control sleeve 60 in an uphole direction within the bore 50*b* against the fluid flow until the pin 54 abuts a lower end of the slot 60*s* on the control sleeve 60, which limits the further axial travel of the control sleeve 60 (and the expansion of the spring 80) within the bore 50*b* in the uphole direction. The spring 80 can be compressed further as will be described below.

The control sleeve 60 is adapted to slide axially in the bore 50*b* (but in this example is resistant to rotation in the bore due to the pin 54 and slot 60*s*), to open and close at least one fluid pathway in the assembly connecting the bore 50*b* with the outlet port 52, in this example to divert the fluid flowing through the bore 50*b* of the body and the bore 60*b* of the control sleeve 60 and out into the annulus of the wellbore, through the outlet port 52 in the body 50.

In the first configuration shown in FIG. 1, the control sleeve 60 is positioned within the body 50 such that an outlet aperture 62 through the control sleeve 60 is out of alignment with the outlet aperture 72 on outlet sleeve 70, closing off fluid communication between the bore 50*b* and the outlet port 52, and maintaining axial fluid flow $F_1$, with the direction of flow as illustrated by the arrow in FIG. 1, in a downhole direction within the bore 60*b* of the control sleeve. This is the running in configuration of the valve assembly before any circulation tasks are started.

The valve assembly 1 is actuated between different configurations to permit and restrict fluid communication between the bore of the valve assembly 50*b* and an external surface of the valve assembly. When the valve assembly 1 is in the running in configuration shown in FIG. 1, the outlet port 52 is obturated by the control sleeve 60, which is urged axially upwards relative to the outlet port 52 to cover it in the first configuration. Annular seals are optionally compressed between the outlet sleeve 70 and the control sleeve 60 in axial positions above and below the outlet port, so that in the closed configuration in FIG. 1, the control sleeve 60 seals off all fluid communication between the bore 60*b* and the outlet port 52, so fluid flows in the axial direction through the bore. The control sleeve 60 has at least one and in this case, two outlet apertures 62 which pass radially through a wall of the control sleeve 60 at the same axial location on the control sleeve 60, and which are spaced diametrically from one another around the circumference of the control sleeve 60. When the control sleeve 60 is in the first configuration shown in FIG. 1, the apertures 62 are above the apertures 72, out of axial alignment with the outlet port 52, and in this configuration, the outlet port 52 is closed and the fluid flowing through the bore 50*b* above the valve assembly 1 flows through the bore 60*b* of the control sleeve and on through the tubular string to the drill bit (for example) in a generally unobstructed manner.

Figure 2:
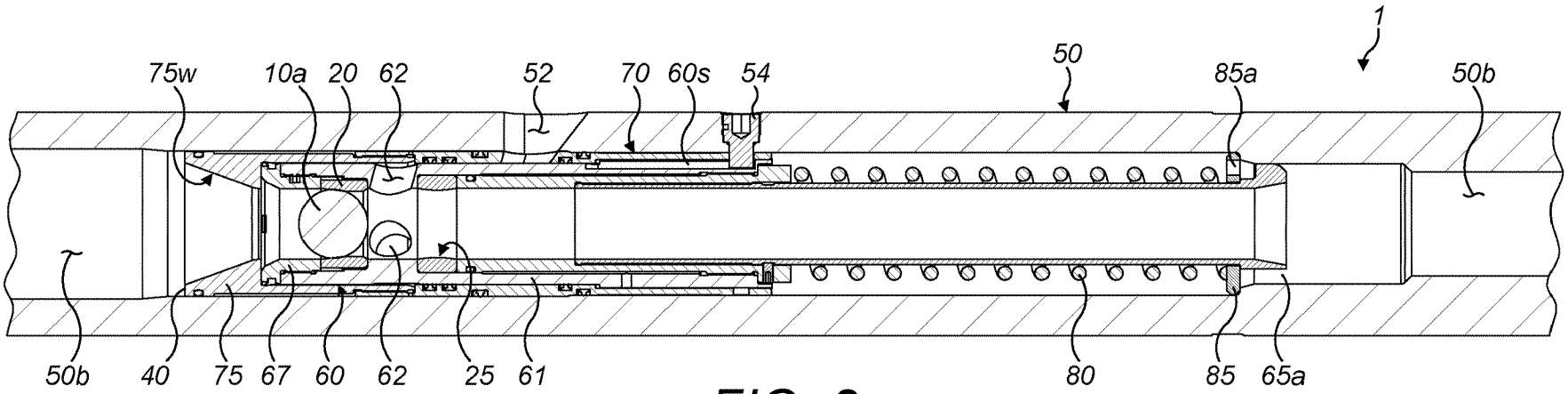
Figure 5:
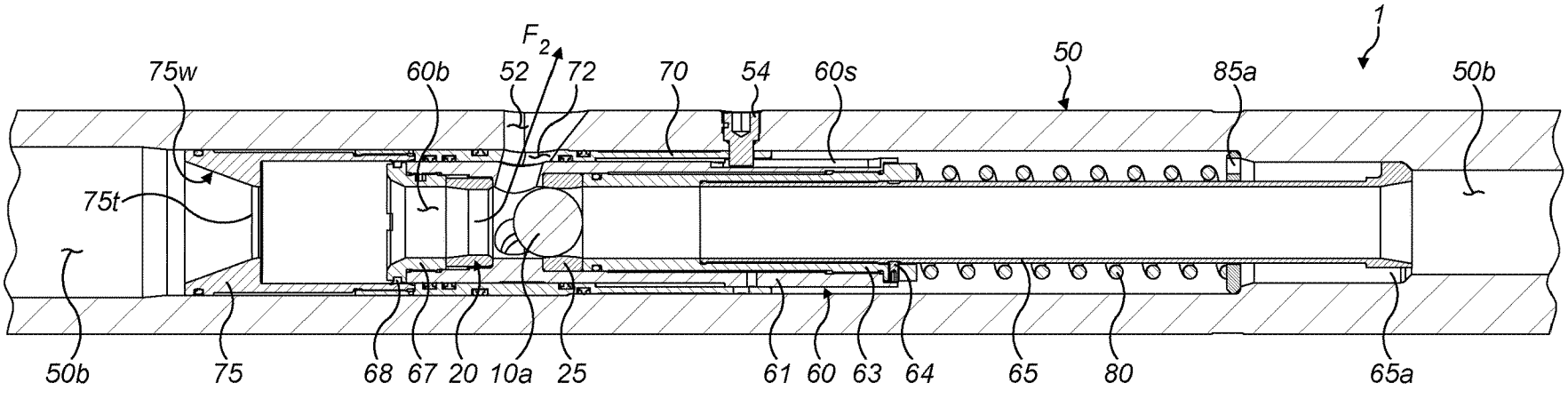

When the outlet port 52 is to be opened and fluid flow is to be diverted to the outlet ports 52 for example in a circulation operation, the control sleeve 60 moves axially down the bore from the first configuration shown in FIG. 1 with axial fluid flow $F_1$, to the second configuration with radial fluid flow $F_2$, as shown in FIG. 5, to open the outlet port 52 as will be described below. The axial travel of the control sleeve 60 can result in the outlet port 52 being fully open (as shown in FIG. 2), fully closed (as shown in FIG. 1), or partially open (an intermediate position between the two).

In this example, the control sleeve 60 further comprises a first seat 20 and a second seat 25 situated respectively on opposite sides (above and below) of the outlet apertures 62. When the control sleeve 60 is in the first configuration of FIG. 1 and the outlet port 52 is closed the seats 20, 25 do not offer any substantial obstruction to axial flow of the fluid through the bore 60*b*. The seats 20, 25 are adapted to seal the bore by seating at least one valve closure member, for example, a ball, a dart, a plug etc. The valve closure member is normally dropped from surface or otherwise released into the tubular above the seats 20, 25, and travels with the fluid flow in a downhole direction to the seats 20, 25, where its further axial travel in the bore 50*b* is prevented, and it closes or substantially obturates the bore of the control sleeve 60 by seating on the seat 20, 25. Each seat 20, 25 is optionally formed as an annular ring of inherently resilient material such as rubber, plastics etc.

Each of the seats 20, 25 is adapted to deform resiliently from the first resting configuration seating the ball 10*a* into a second radially compressed configuration to allow passage of the ball 10*a* past the seats when the force urging the ball 10 downwards in the bore overcomes the inherent resilience of the material of the seat 20, 25 reacting against it. The valve seats 20, 25 extend radially inwards into the bore 60*b* of the control sleeve 60. The inner radial dimension of each seat 20, 25 in a resting configuration where no force is acting on it is smaller than the maximum radial dimension of the ball 10*a* so that the ball 10*a* seats on the seats 20, 25. The inner radial dimension of each seat 20, 25 is adapted to expand radially during deformation and axial passage of the ball through the seat 20, 25, such that the radial thickness of each seat 20, 25 reduces transiently during deformation. Thus as the ball 10*a* passes through the valve assembly under the force of the fluid pressure above it, the inner faces of the seats 20, 25 are resiliently compressed in a radially outward direction by the non-deformable ball 10*a* acting under the force of fluid pressure directed downhole from the surface. Each seat 20, 25 optionally maintains a consistent outer radial dimension and volume in the resting and deformed configurations, and merely changes shape when deforming.

In this example, the control sleeve 60 optionally comprises an assembly of separate sleeves which are interconnected, mainly for reasons of easy assembly and disassembly for the replacement or servicing of the various parts. In the present case, the control sleeve 60 comprises a central sleeve 61 having a radially inwardly extending shoulder extending into the bore 60*b* and accommodating the outlet apertures 62 within that shoulder. Below the shoulder, the central sleeve 61 is internally threaded for connection to a lower sleeve 63 having an external threaded section which is received within the bore of the central sleeve 61. The lower sleeve 63 also has an internally threaded bore at its lower end, which accommodates spring sleeve 65, which is assembled together with the spring which fits over the spring sleeve 65 before the spring sleeve 65 is offered to the threaded internal bore of the lower sleeve 63. In this example, the lower sleeve 63 and spring sleeve 65 can be secured after assembly of the spring by a grub screw 64 extending between each after the thread has been made up. Other methods of connecting the sleeves can of course be used. The assembly of the lower sleeve 63 and spring sleeve 65 is then offered into the bore of the central sleeve 61. At the upper end of the central sleeve 61, a cap 67 is threaded onto the upper end of the control sleeve. This multipart structure allows the easy assembly, disassembly and replacement of the seats 20, 25, which in this example are in the form of annular rings of resilient material which are offered to the opposing end bores of central portion 61 before assembly of the other components, and which abut the radially inwardly extending shoulder on opposite sides of the outlet aperture 62. For example, after insertion of the second seat 25 into the bore of the lower end of the central portion 61, the assembled lower sleeve 63 and spring sleeve 65 is then connected to the central portion 61 to secure it in place. The cap 67 is fitted to the upper end in the same way, once the first seat 20 has been received in place against the upper face of the inwardly radially extending shoulder. Seals are provided between the various sleeve components so that when assembled, the connected sleeves effectively perform as a single unit 60 while allowing disassembly for replacement and servicing of components such as the seats 20, 25.

Figure 3:
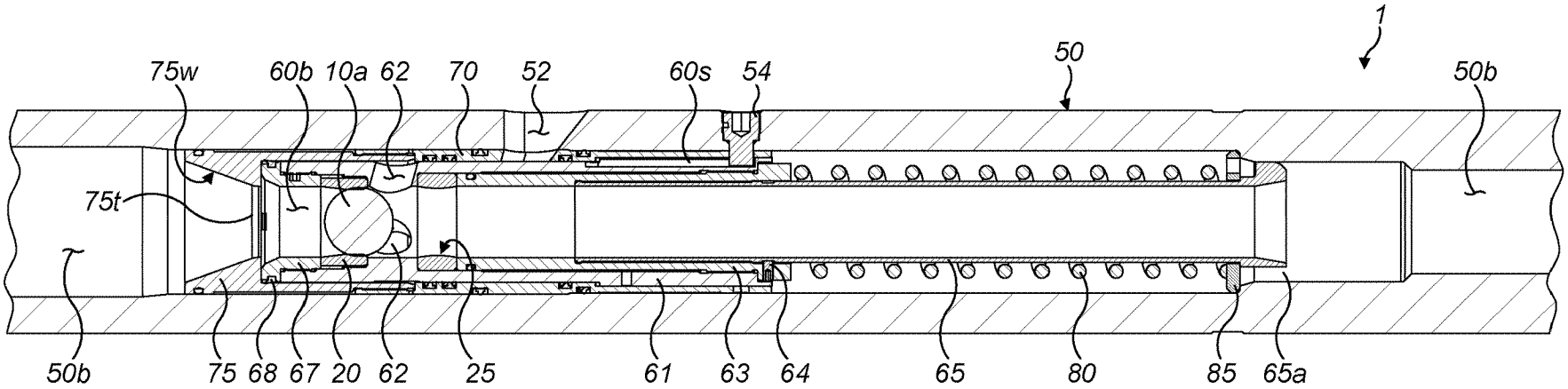
Figure 4:
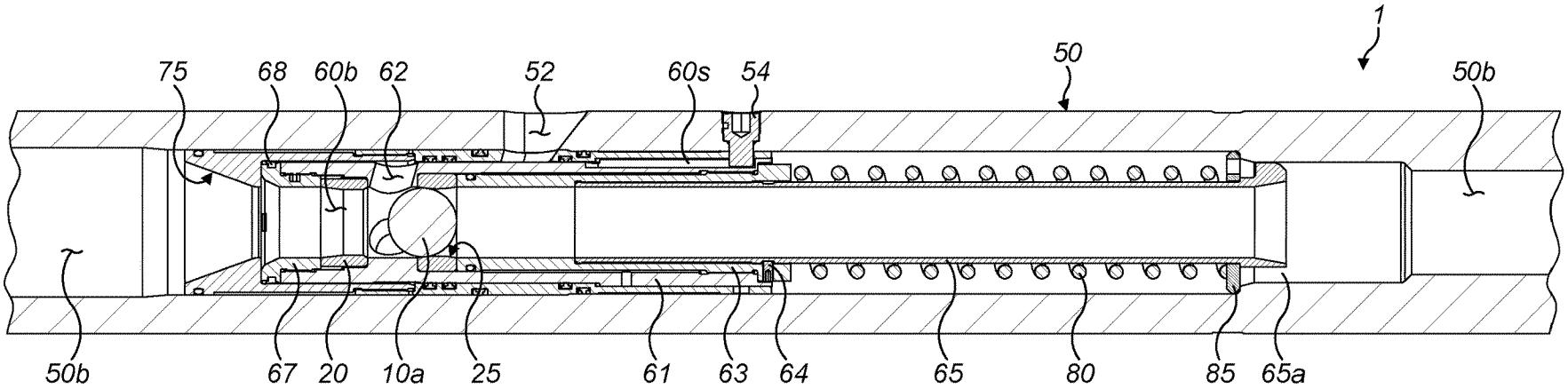

FIGS. 2 and 3 show the valve assembly 1 of FIG. 1, with a first valve closure member in the form of a first ball 10*a* seated on (FIG. 2) and passing through (FIG. 3) the first seat 20. The first seat 20 deforms radially to allow passage of the ball 10*a* under a relatively small pressure differential applied by the fluid above the seated ball 10*a*, which is insufficient to compress the spring 80. As the fluid pressure builds above the seated ball 10*a* to the first pressure threshold, the ball 10*a* moves from the FIG. 2 seated position to the FIG. 3 "passing through" position as the first seat 20 deforms radially outwards to allow the passage of the ball 10*a* through the first seat 20. As the spring 80 remains uncompressed at these relatively low pressures, the control sleeve 60 remains still and the outlet port 52 remains closed, so fluid pressure above the seated ball 10*a* does not escape from the bore 50*b*. Eventually the ball 10*a* squeezes through the first seat 20 and seats on the second seat as shown in FIG. 4. The second seat 25 has a higher elastic modulus than the first seat 20, so does not initially deform in response to the pressure differential which is still relatively low at this point, just above the first pressure threshold. However, since the bore 50*b* is now blocked, as the ball 10*a* is seated on the second seat 25, the pressure differential across the seated ball 10*a* on the second seat 25 continues to build as the fluid is pumped from the surface.

As the increasing fluid pressure differential across the seated ball 10*a* starts to overcome the force of the spring 80 supporting the control sleeve 60, the pressure is generally higher than the first pressure threshold needed to push the ball through the relatively soft first seat, but lower than the second pressure threshold needed to push the ball 10*a* through the harder second seat, so while the control sleeve 60 is urged axially under the fluid pressure the ball 10*a* stays seated on the second seat 25 blocking the bore. The fluid pressure acting on the seated ball 10*a* increases eventually to a required activation pressure needed to overcome the spring force, and at this point the force of the fluid above the seated ball 10*a* pushes the control sleeve 60 axially in a downhole direction. The pins 54 allow the control sleeve 60 to translate in an axial direction without a rotational component, thus maintaining the axial alignment of the aperture 62 with the outlet sleeve aperture 72 and the outlet port 52. The axial movement of the control sleeve 60 compresses the spring 80 between the control sleeve 60 and the spring retainer 85 as can be seen in FIG. 5. As the control sleeve 60 moves in a downhole direction relative to the outlet sleeve 70 and the body 50, the aperture 62 moves into alignment with the aperture 72 and the outlet port 52, which allows the pressurised fluid to escape in a radial direction into the annulus of the wellbore for circulation of the fluid above the drill bit for example. These high pressure jets of fluid can be used for, for example, cleaning the annulus, or washing drill cuttings back to the surface. The fluid is prevented from flowing into the space between the body 50 and the outlet sleeve 70 by a pair of seals situated just uphole and just downhole of the outlet sleeve aperture 72. The space between the control sleeve 60 and the outlet sleeve 70 is similarly sealed off. Thus, the fluid is directed to flow solely out of the outlet port 52 and is prevented from escaping through other paths.

Once the ball 10*a* is in the FIG. 5 position, the pumps can be driven continuously to maintain the pressure differential and perform circulation tasks. The pumps can optionally be switched off to remove the pressure differential, and release the ball 10*a* from the second seat 25, causing the spring 80 to expand and return the control sleeve 60 to the FIG. 1 position, and this can be done without fear of losing the ball 10*a* for example in a deviated wellbore, because the first seat 20 resiliently recovers to its original form shortly after passage of the ball 10*a*, regaining the apex ID that is narrower than the ball 10*a* which deformed it to squeeze through, and hence after passage through the first seat 20, the ball 10*a* is trapped between the first and second seats 20, 25, and can readily be re-applied to the second seat by just switching on the pumps again. This is especially useful if the wellbore is deviated or horizontal, as the resiliently recovered first seat stops the ball from rolling back up the bore 50*b* away from the seat 25. The seats 20, 25 are spaced apart by a relatively short distance, optionally between 1× and 2× the diameter of the ball 10*a*, or the ID of the seats 20, 25. The distance between the apexes of the seats is optionally chosen so that when the first ball 10*a* is seated on the second seat 25, the second ball 10*b* is supported by the first ball 10*a* (and therefore its movement is arrested by the seated first ball 10*a*) at the same time as the second ball 10*b* is seated on the first seat 20. Hence, the ball 10*a* is kept available for re-application to the second seat 25 when required, and the pumps do not need to be continuously operated, and can be switched on and off as required to open and close the port during the circulation operations. This can happen as many times as is needed during circulation operations.

The force required to deform the second seat 25 is higher than that required to deform the first seat 20, and is also higher than what is required for most circulation operations, so in the FIG. 5 configuration, especially since the fluid pressure is escaping the bore 60*b* via the open outlet port 52, the second seat 22 has not yet resiliently deformed and continues to seat the ball 10*a* between the first and second seats 20, 25, which are axially spaced from one another along the axis of the bore 50*b* on opposite sides of the outlet apertures 62 and outlet ports 52. Circulation operations can thus be performed as needed with the ball 10*a* in the FIG. 5 position. When circulation operations are completed and the valve assembly is to be reset to the starting configuration, for example for the resumption of drilling, or for the performance of operations below the valve assembly, the ball 10*a* is unseated from the second seat 25 as follows.

Figure 6:
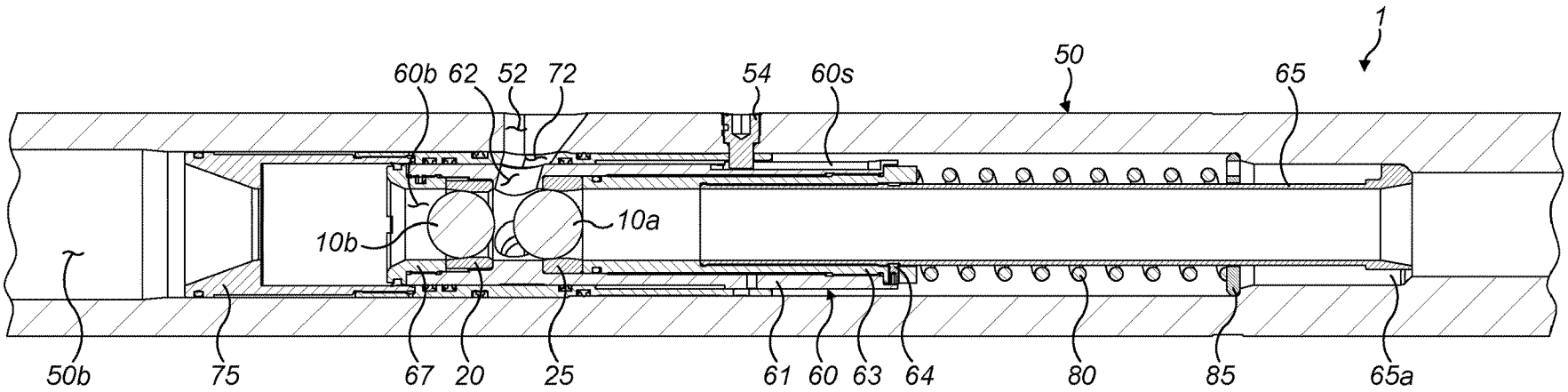

Unseating of the ball 10*a* from the second seat 25 can be initiated when the control sleeve is still in the FIG. 5 configuration, with the outlet port 52 radially aligned with the control sleeve aperture 62 and the ball 10*a* seated on the seat 25. In order to reset the valve assembly 1 to the initial drilling configuration and to unseat the ball 10*a*, a second valve closure member in the form of a ball 10*b* is inserted into the bore 50*b* of the body 50 above the seat 25 while the first ball 10*a* is seated on the second seat 25. The second or further ball 10*b* lands on first seat 20 as shown in FIG. 6, blocking the bore once more and forcing the second ball 10*b* through the first seat 20 as the pressure differential exceeds the first pressure threshold.

The axial distance between the apexes of the first and second seats 20, 25 is chosen to be between 1× and 2× the maximum outer diameter of the balls 10*a*, 10*b*, so that when the second ball 10*b* has is seated on the first seat 20 with its maximum OD engaged in the apex of the first seat 20, the second ball 10*b* is abutting the first ball 10*a* seated on the second seat 25. In this configuration, shown in FIG. 7, the second ball 10*b* seals off the bore 60*b* of the control sleeve 60 above the aperture 62, thereby substantially obturating the bore 60*b* of the control sleeve 60 and effectively preventing escape of the fluid through the outlet port 52. Fluid pressure within the closed bore 50*b* above the seated second ball 10*b* then rapidly builds up to a second fluid pressure threshold that is higher than the first fluid pressure threshold, higher than the activation pressure for opening the valve outlet, and also higher than normal operating pressures for the circulation tasks. At the second pressure threshold the fluid pressure above the obturated bore has increased to a level at which the force urging the balls 10*b*, 10*a* downwards in the bore 60*b* is greater than the resilient force maintaining the ball 10*a* on the second seat 25, and the higher force exerted by the fluid forces the first and second balls 10*a*, 10*b* rapidly through the second seat 25, which resiliently deforms as the balls 10*a*, 10*b* pass through it, before returning to its original configuration. The balls 10*a*, 10*b* are optionally caught in a ball catcher device (not shown) after they have passed through the seat 20.

Figure 8:
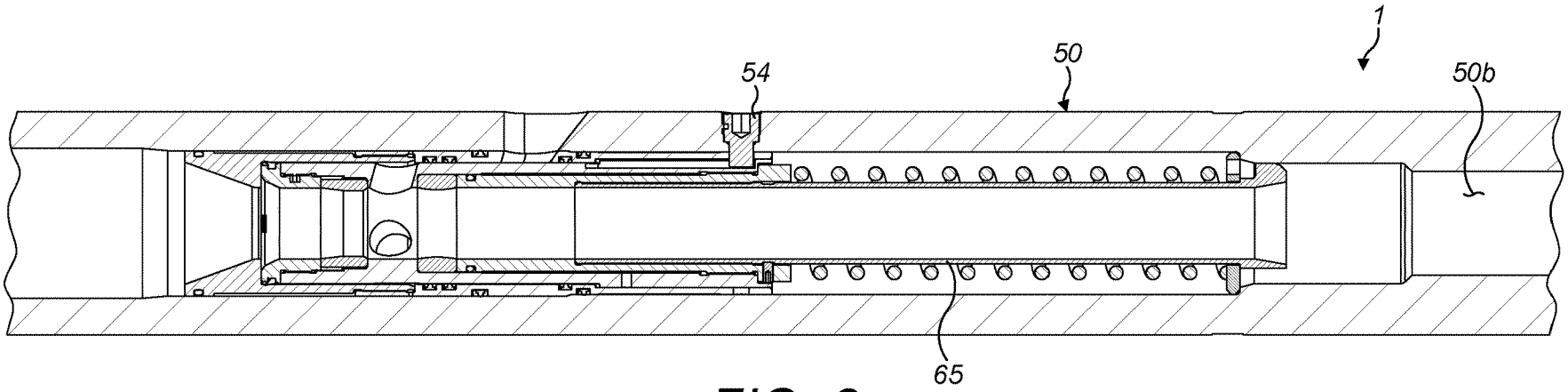
Figure 9:
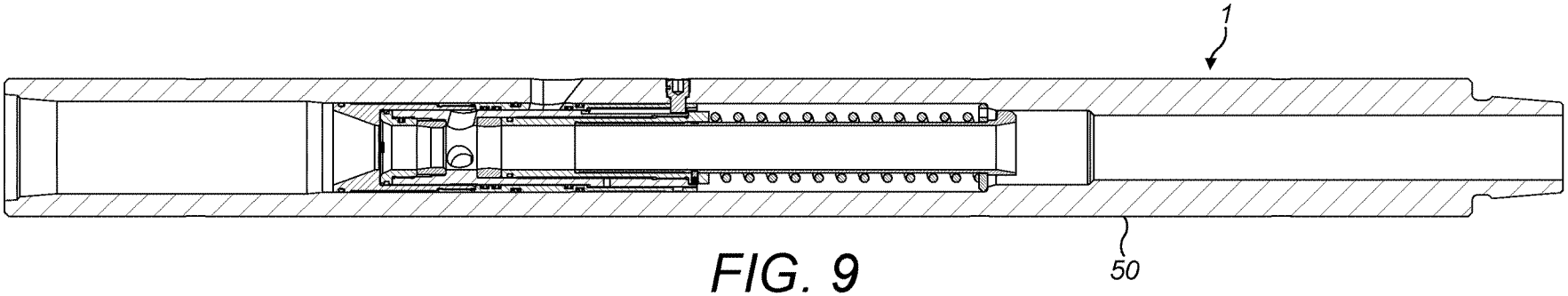
FIGS. 9-16 show views of the valve assembly according to FIGS. 1-8 in the context of a tubular adapted for connection into a string.
Figure 10:
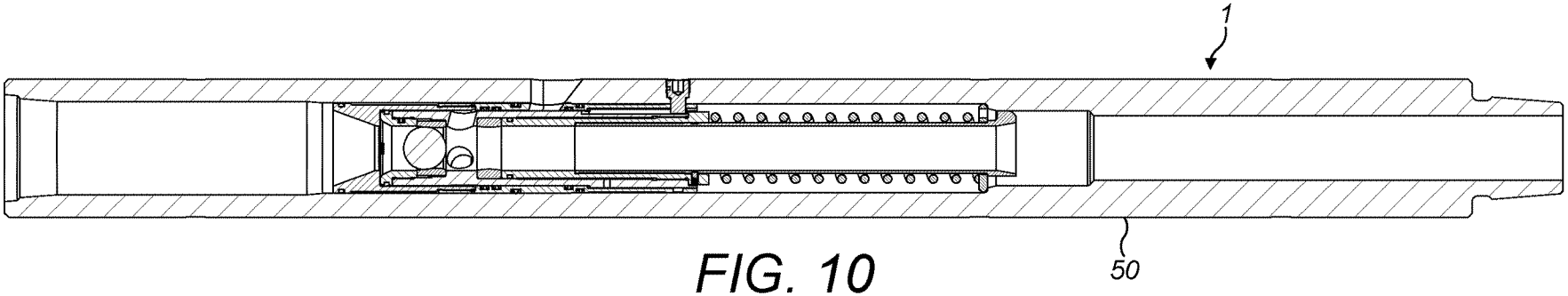
Figure 11:
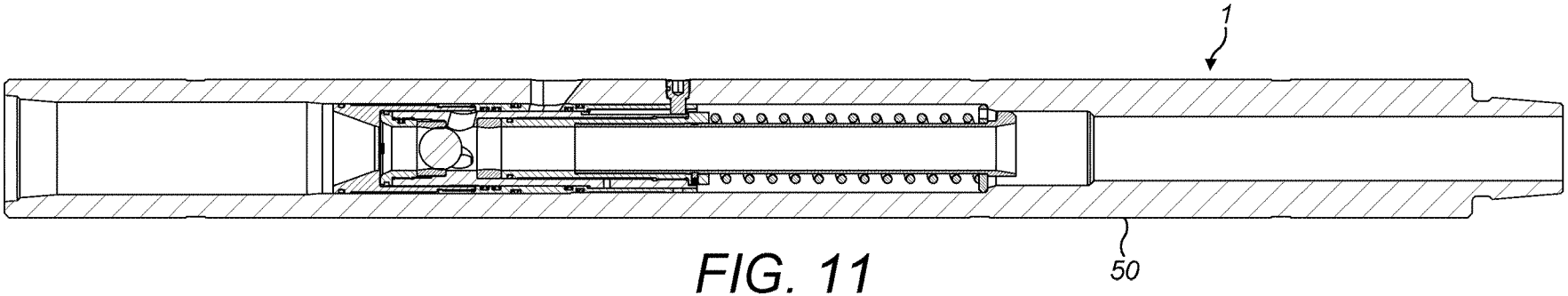
Figure 12:
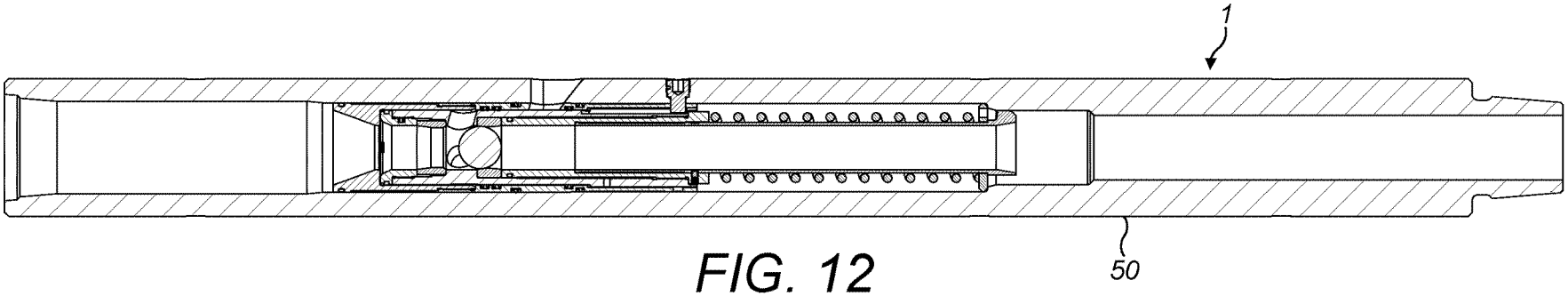
Figure 13:
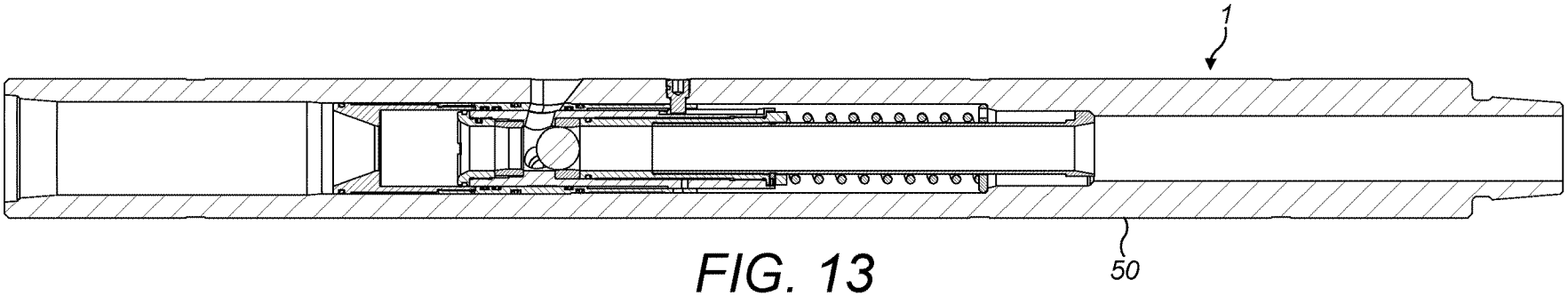
Figure 14:
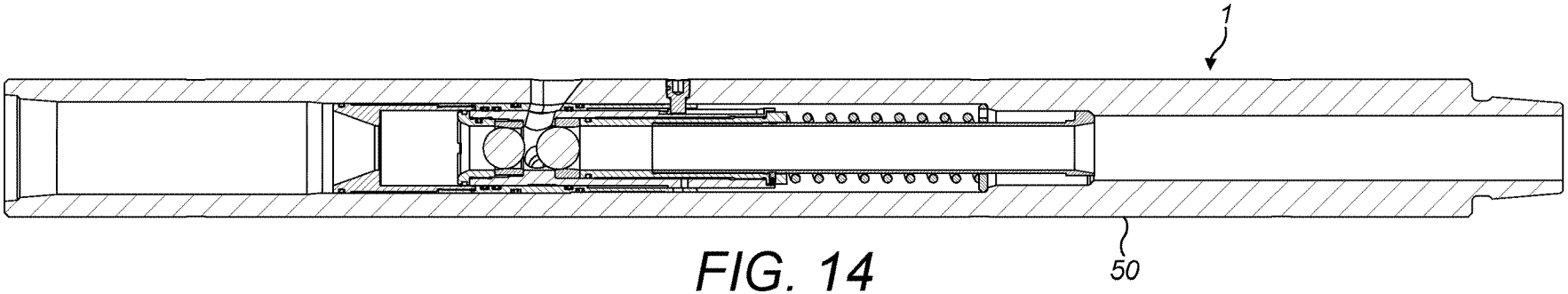
Figure 15:
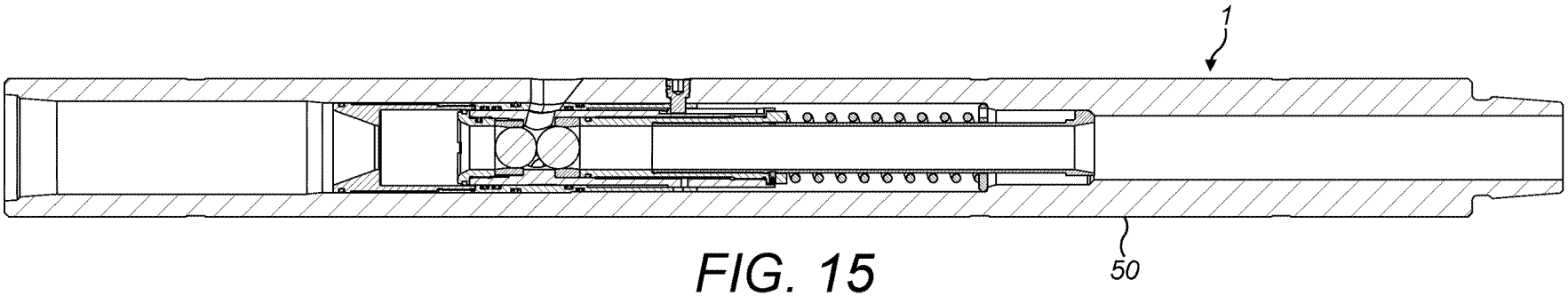
Figure 16:
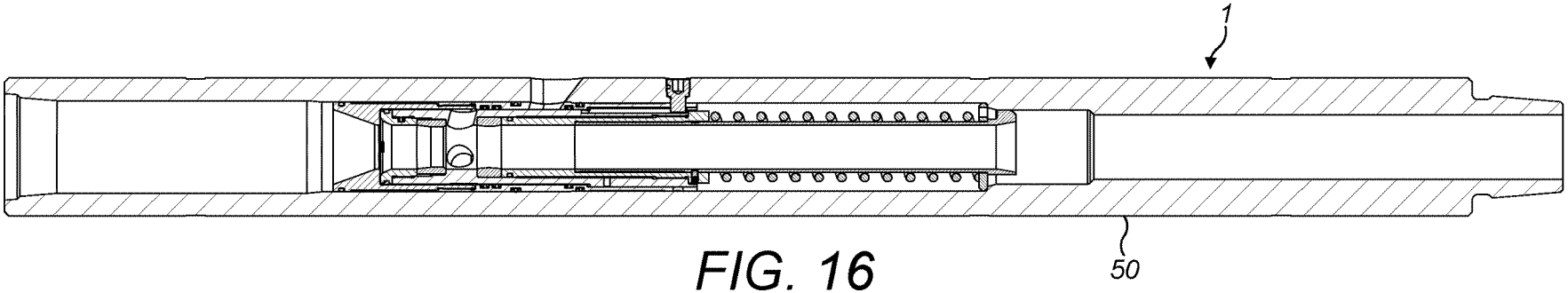

In this example, the first seat 20 and the second seat 25 optionally take different forms. According to one option, as best seen in FIG. 8, the first seat has a generally asymmetric cross-section, with an upper funnel section having a wide upper mouth converging to a reduced ID above the apex, which has the narrowest ID of the seat. The apex is disposed below funnel section, nearer to the lower end of the first seat 20 than the upper end. When a ball or other valve closure member seats on the first seat 20, it is received in the upper funnel section, and in this example, the diameter of the ball and the inner diameter of the apex are selected so that the ball 10 seats on the first seat 20 most firmly when the maximum OD of the ball 10 has passed the funnel section and is engaged on the apex. As can be best seen in FIG. 8, the apex of the first seat is generally cylindrical with a generally consistent ID along its axial length, and a good seal is obtained between the ball maximum OD and the apex of the first seat 20 substantially along the whole axial distance of the cylindrical apex. This is useful because it ensures that a consistent seal is formed between the first seat 20 and the second ball 10*b* while the first ball 10*a* is being pushed through the apex of the second seat 25. At that time, both balls are moving down the bore 60*b* under the relatively constant pressure. The second ball 10*b* optionally only moves out of the cylindrical apex of the first seat 20 after the first ball 10*a* has passed through the apex of the second seat 25, so the pressure differential across the second ball 10*b* is maintained relatively constant until the second ball 10*b* has dropped through the cylindrical apex in the first seat 20. In some examples, the apex does not require to be of consistent ID, and can have a radius. The lower end of the seal 20 below the cylindrical apex optionally has a chamfered section that diverges radially outwardly from the apex, to reduce the resilient force applied to the ball as it moves axially out of the apex, and to reduce the erosion experienced by the seat 20 in use. The cylindrical apex of the first seat optionally has a narrower ID than the apex of the second seat below it.

The second seat 25 typically has around the same axial length as the first seat 20, but the ID is radiused and non-linear as best shown in FIG. 8. The radiused ID of the second seat 25 reaches its narrowest point at an apex, which is generally at the centre of the seat 25, so the second seat 25 is generally symmetrical. The apex of the second seat 25 has a very slightly wider ID than the apex of the first seat 20 The ball 10*a* is most firmly seated on the second seat 25 when its maximum OD is just above the apex, as shown in FIG. 5, and the ball is less firmly retained by the seat 25 as soon as the maximum OD has moved below the radiused apex of the second seat 25. This is a useful feature as it allows the second seat 25 to retain the first ball 10A firmly on the upper side of the apex, as shown in FIG. 5, and does not delay its retention in the seat as soon as it has squeezed past the apex. In fact, since the ID of the second seat 25 is continuously expanding on an arc below the apex, the resilient recovery of the second seat after deformation can optionally assist in the ejection of the ball 10A from the second seat 25 at the second pressure threshold.

The inherent resilience of the material of the seats 20, 25 is optionally such that the original configuration as shown in FIG. 8 is not immediately recovered after the balls are forced through in response to the second pressure threshold, so the second seat 25 is optionally still partially resiliently deformed as the second ball 10*b* passes it under the force of the second pressure threshold. Optionally the second ball 10*b* is very slightly smaller than the first ball 10*a*, so that it can pass more easily through the seats 20, 25, and is not retained in the second seat 25 when the second pressure threshold is applied.

In this example, the outlet apertures 62, 72 and the outlet port 52 are optionally directed at least in part in a non-perpendicular direction with respect to the axis of the bore 50*b*. Thus, each of the outlet apertures 62, 72 are at least partially directed radially outwardly at an angle toward the lower end of the tool (to the right as shown in the drawings). The outlet port 52 in the body 50 has a radial upper section, and a diverging lower section, which diverts the jet of fluid passing through the outlet apertures 62, 72 in a generally downward direction, as well as radially outwardly. This can be useful in directing jets of fluid to particular areas of the bore hole, beneath the outlet port 52 which require particular cleaning or maintenance, and the canted angle of the jets can in some cases perform better cleaning operations than perpendicular jets.

The first and second pressure thresholds can optionally vary in different examples, but an optional first pressure threshold could be similar to what a wellbore would withstand in a normal circulation operation. In the present example, a suitable pressure to open the ports and allow flow is around 100-300 psi, for example, 150 psi, which is optionally sufficient to overcome the force of the spring, and the resilience of the first seat 20, but not the resilience of the stiffer second seat 25. The second pressure threshold is optionally higher than the first pressure threshold, and could be from 1000-2000 psi, for example 1500 psi and is optionally sufficient to overcome the resilience of the second seat 25 and to force the balls 10 through the seat 25. The spring strength is optionally chosen in light of the likely operating pressure which will influence the desired first pressure threshold.

Once the balls 10*a*, 10*b* have passed through the seat 20, the obstruction of fluid flow through the bores 50*b*, 1*b* is removed, and the fluid pressure drops suddenly, reducing below the level needed to compress the spring 80. The spring 80 then returns the control sleeve 60 under its upward biasing force to the initial first configuration shown in FIG. 8, where the aperture 62 is situated uphole of the outlet sleeve aperture 72, out of alignment with the aperture 72 and the outlet port 52, and the outlet port 52 is closed off from the bore 50*b* by the control sleeve 60 and its seals. Fluid flow through the radial pathway $F_2$ is thus prevented and flow resumes along the axial pathway $F_1$. Drilling can then resume with the fluid being directed to the drill bit to wash cuttings back to the surface.

In the present example, the cap 67 disposed at the uphole end of the control sleeve optionally includes a bladed component, which is urged resiliently against the inner surface of the wall of the outlet sleeve 70, and in this example is in the form of a resilient wiper 68, but a rigid scraper or similar could also or alternatively be provided. The wiper 68 can be formed from a resilient material, for example a plastic or rubber material. The wiper 68 covers the upper end of the annulus between the control sleeve 60 and the outlet sleeve 70, and reduces the amount of debris accumulating therein. As the control sleeve moves in the bore of the outlet sleeve 70, the wiper 68 scrapes against the inner surface of the outlet sleeve and cleans off debris. The inner diameter of the cap 67 is larger than the inner diameter of the seat 20, in order to avoid any erroneous seating of the ball 10*a* in the cap 67 before it reaches the seat 20.

The threaded connection of the cap 67 with the control sleeve 60 allows removal of the component for repair or replacement without requiring complete disassembly of the other valve sleeves. This also permits, for example, the insertion of components to narrow the bore of the control sleeve 60 further for use with different sizes of balls or other shapes of plugs.

At the uphole edge of the outlet sleeve 70, there is a cap 75 connected by threaded attachment to the outlet sleeve 70. The cap 75 has an upper end which offers a leading edge 40 facing in an uphole direction, against the fluid flow F. The outer wall of the cap 75 is cylindrical with parallel sides to match the inner bore 50*b*, but the inner wall 75*w* of the cap has a shaped profile which tapers radially inwards into the bore of the cap 75 to a throat 75*t*, which is narrower than the upper end of the bore of the cap 75. The inner wall of the cap 75*w* therefore forms a funnel in the bore, which acts to reduce turbulence and drag within the flow of the fluid, and to smooth out any eddies that would otherwise have been created by the upper end of the outlet sleeve 70. The funnel provided by the inner wall 75 directs fluid into the bore 60*b*, with a diameter that is at least equal to the diameter of the bore 60*b*, but can optionally be less than the diameter of the bore 60*b*.

In another optional feature, the control sleeve 60 is optionally castellated at its downhole end with arches 65*a* cut out of the sleeve material, but other shapes may be used. The arches 65*a* permit fluid flow to the annular space in between the control sleeve 60 and the valve body 50, into the cavity where the spring 80 is retained. In this case, when the control sleeve 60 moves in a downhole direction, the spring is free to compress as fluid is forced out of the cavity through the arches 65*a* and into the bore 50*b*. Similarly, when the control sleeve 60 is travelling back in an uphole direction to its initial configuration, the spring 80 must extend, and fluid can flow through the arches 65*a* into the spring cavity to fill the vacuum that the extension creates. This feature reduces the risk of hydraulic lock of the control sleeve 60. The spring retainer 85 likewise optionally has similar formations 85*a* allowing fluid communication and preventing or alleviating risks of hydraulic locking of the moving parts of the assembly 1.

An operation using the above example will now be described. During wellbore operations, for example downhole drilling, fluid is normally pumped axially down the drill string to the drill bit for cooling the bit, and for washing cuttings back to the surface. The option of diverting the fluid being pumped down the bore of the string into a radial fluid flowpath can be desirable in order to e.g. clean drill cuttings from the annulus of the wellbore. In this example, the ball 10*a* is dropped from the surface and travels through the bore of the string under the combined force of gravity and fluid being pumped down the well by positive displacement pumps at the surface. The ball 10*a* enters the bore 50*b* of the valve assembly 1 and passes through the cap 75 of the outlet sleeve 70. The ball 10*a* then passes through the cap 67 of the control sleeve 60, landing on the first seat 20. When engaged with the first seat 20, the non-deformable ball 10*a* forces deformation of the resilient first seat 20 under the initial force of fluid pressure in the bore behind the ball 10*a* once the pressure differential reaches the first (relatively low) pressure threshold. As the ball 10*a* passes through the apex of the first seat 20, the seat 20 is radially compressed by the ball 10*a*, such that its radial thickness is reduced and the diameter of the bore increases in a transient and reversible manner, but while the outer diameter of the seat 20 and its volume remains unchanged. After passing the first seat 20, the ball 10*a* seats on the second seat 25 on the other (lower) side of the outlet aperture 62. The second seat 25 requires more force to deform and allow passage of the ball 10*a*, and so the ball 10*a* is thus held seated on the second seat 22 at the relatively low first threshold pressure.

The seating of the ball 10*a* in the second seat 25 obturates the axial fluid flowpath $F_1$, as the seat 25 sealingly engages with the ball 10*a*. The resulting increase in fluid pressure uphole of the valve assembly 1 and into the bore 50*b* applies a correspondingly increasing force to the uphole-facing surface of the seated ball 10*a*. Once the fluid pressure has reached a threshold where the force applied to the ball 10*a* is greater than the opposing biasing force of the spring 80 (the activation pressure) the control sleeve 60 begins to travel axially in a downhole direction, and is guided in an axially-travelling path by the inner ends of the pins 54 occupying axial slots on the outer surface of the control sleeve 60. Any rotational movement of the control sleeve 60 at this point could lead to the aperture 62, through the wall of the control sleeve 60, being misaligned relative to the aperture 72, through the wall of the outlet sleeve 70, and the outlet port 52, through the side wall of the body 50. Hence, preventing rotation via the pins 54 increases consistency of fluid flow through the open outlet port 52.

The spring 80 is compressed between the spring retainer 85 and the lower end of the control sleeve 60, with the compression increasing as the control sleeve 60 travels axially downwards. The control sleeve aperture 62 begins to cross the outlet aperture 72, allowing a small volume of fluid to be diverted out of the outlet port 52, which is fully aligned with the aperture 72. This diversion of fluid can sometimes slightly reduce the fluid pressure acting on the control sleeve 60, and pumping from the surface can optionally increase accordingly in order to maintain sufficient force to continue compressing the spring 80. Once the control sleeve 60 has reached the full extent of its travel, the apertures 62, 72 and the outlet port 52 are fully aligned, and the flow of fluid is diverted along the radial flowpath shown as arrows $F_2$ in FIG. 5, through the apertures 62, 72, and outlet port 52, into the annulus of the well bore. Full alignment is not strictly necessary for satisfactory performance, but it is convenient to shift the control sleeve 60 by the same amount each time. The downward axial travel of the control sleeve 60 in the bore can optionally be limited by a travel stop formed by an internal shoulder on the body 50 engaging the lower end of a component of the control sleeve 60, and/or by the pin 54 reaching the upper end of the slot 60*s*.

Figure 7:
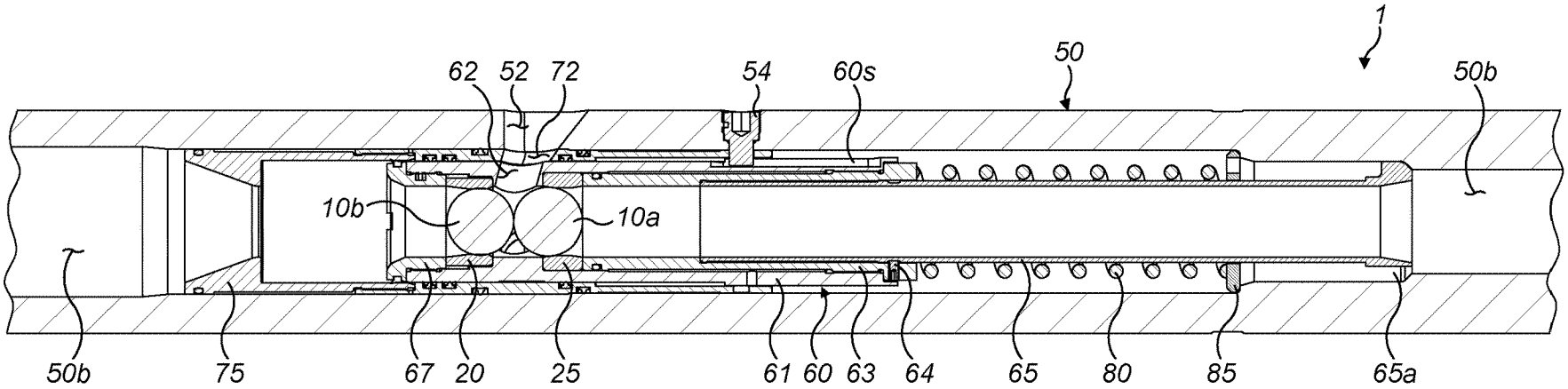

Once the function of the radial flow of fluid into the annulus has been performed (and repeated as needed) and the operator wishes to return the fluid flow to an axial direction through the valve assembly 1, a second ball 10*b* is dropped from the surface, and travels through the string to the valve assembly 1 under the combined force of gravity and fluid flow. The ball 10*b* is slightly narrower than the ball 10*a*. It passes through the narrowed bore of the cap 67 and seats on the first seat 20, as shown in FIG. 7, at the same time, abutting on the uphole-facing surface of the first ball 10*a*, which remains retained in the second seat 25. The second ball 10*b* seating on the first seat 20 obturates the bore 60*b* at a position uphole of the aperture 62, thus blocking the bore 60*b*.

Fluid pressure increases above the seated balls 10*a*, 10*b*, (and can optionally be increased from the surface as required) to a second pressure threshold which is optionally considerably higher than the first threshold and higher than the activation pressure. This increases the force bearing down on the uphole-facing surface of the seated second ball 10*b*, which in turn bears down on the first ball 10*a*. Since the second ball 10*b* is supported from below by the first ball 10*a* seated on the second seat 25, it cannot move through the first seat 20, remaining within the cylindrical apex thereof, and the pressure therefore cannot escape through the outlet 52. The downhole-directed force applied by the higher second pressure threshold finally drives the non-deformable ball 10*a* down the bore 60*b* to begin deformation of the second valve seat 25 and press into the narrow apex of the second seat 25. The ball 10*a* causes the second seat 25 to compress in a radially outward direction, transiently increasing the diameter of the bore formed by the second seat 25 (while optionally maintaining outer diameter and volume), and allowing both balls 10*a*, 10*b* to pass through the second seat 25. Since the ball 10*b* is slightly narrower than the ball 10*a*, it is not seated as firmly in the second seat 25. In some examples, it is sufficient that the OD of the ball 10*b* is slightly larger than the ID of the second seat 25, so it can seat on the second seat 25, but since the balls 10*a*, 10*b* pass through in quick succession, while second seat 25 is still resiliently recovering to its initial resting configuration after passage of the larger first ball 10*a*, passage through the second seat 25 by the second ball 10*b* is facilitated by the transient deformation of the seat 25 by the passage of the first ball 10*a*.

In some examples, and in the case of this example, the OD of the second ball 10*b* is very slightly smaller than the ID of the second seat 25, so the second ball 10*b* does not actually seat on the second seat 25, and passes through it without restriction. The balls 10*a*, 10*b*, are then optionally caught in a ball catcher downhole of the valve assembly (not shown). The first and second seats meanwhile resiliently return to their initial uncompressed configuration.

Once the balls 10*a*, 10*b* have passed through the seat 20, the fluid pressure is relieved through the axial bore 50*b*, and there is nothing to maintain the compression of the spring 80 which returns the control sleeve 60 to its original upper position. As the control sleeve 60 moves in an uphole direction, the wiper 68 wipes against the inner surface of the outlet sleeve 70 and cleans away debris, reducing the risk of the control sleeve 60 jamming and maintaining the smooth running of the control sleeve within the outlet sleeve 70, and keeping any debris from entering the annulus between the control sleeve 60 and the outlet sleeve 70, and degrading the seals therein. Once the control sleeve 60 has returned to its initial position, the aperture 62 is wholly out of alignment with the aperture 72 and the outlet port 52 and the fluid flow returns to an axial path, shown as arrow $F_1$ in FIG. 1.

The invention claimed is:

1. A valve assembly for use in a wellbore of a well, the valve assembly comprising:

a body with a bore for flow of fluid through the valve assembly, the bore having an axis; a valve closure member;

a control sleeve which is axially movable within the bore relative to an outlet port provided in the body between open and closed configurations of the control sleeve to open and close fluid communication between the outlet port and the bore, and first and second resiliently deformable seats axially spaced from one another in the bore and each adapted to seat the valve closure member in the bore, to resist the passage of fluid through the bore past the seated valve closure member, wherein the first and second seats are disposed in the control sleeve, wherein the first seat is adapted to resiliently deform from a first resting configuration to a second deformed configuration of the first seat to allow passage of the valve closure member past the first seat at a first threshold pressure of fluid acting on the valve closure member seated on the first seat, wherein the second seat is adapted to resiliently deform from a first resting configuration to a second deformed configuration of the second seat to allow passage of the valve closure member past the second seat at a second threshold pressure of fluid acting on the valve closure member seated on the second seat, wherein the second threshold pressure is higher tha n the first threshold pressure, and wherein the first and second seats are axially spaced from one another along the axis of the bore on opposite sides of an inner end of a selectively operable fluid outlet conduit connecting the bore with an external surface of the valve assembly.

2. The valve assembly of claim 1, wherein each of the first and second seats has an inner diameter providing a restriction in the bore at an apex of the respective first and second seats, and wherein the apexes of the first and second seats are axially spaced apart by a distance greater than the inner diameter at the apex of at least one of the first and second seats.

3. The valve assembly of claim 2, wherein the apex of at least one of the first and second seats comprises the narrowest part of the bore.

4. The valve assembly of claim 1, wherein the first and second seats are each radially compressible, with an inner diameter:outer diameter ratio which increases as the valve closure member passes through each of the first and second seats.

5. The valve assembly of claim 1, wherein an inner diameter and a radial thickness of each of the first and second seats recover resiliently to the respective first resting configurations after axial passage of the valve closure member through the first and second seat.

6. The valve assembly of claim 1, wherein the first seat is closer to an entry of the wellbore into a formation in which the wellbore is drilled than the second seat.

7. The valve assembly of claim 1, wherein the second seat has a higher elastic modulus than the first seat.

8. The valve assembly of claim 1, further comprising a resilient device, wherein the control sleeve is biased resiliently against the direction of fluid flow through the bore of the valve assembly by the resilient device.

9. The valve assembly of claim 1, wherein the first and second seats comprise mutually parallel rings extending circumferentially around an inner surface of the control sleeve.

10. The valve assembly of claim 1, wherein the first and second seats each extend radially inwards from an inner surface of the control sleeve, creating a throat in each of the first and second seats that is narrower than a bore of the control sleeve and a sealing diameter of the valve closure member.

11. The valve assembly of claim 1, wherein rotation of the control sleeve relative to the outlet port is restricted.

12. The valve assembly of claim 1, wherein the control sleeve is biased in the closed configuration and wherein fluid pressure above the seated valve closure member at the first threshold pressure is insufficient to move the control sleeve from the closed configuration.

13. The valve assembly of claim 1, wherein the control sleeve is biased in the closed configuration and wherein fluid pressure above the seated valve closure member between the first and second threshold pressures causes the control sleeve to move from the closed configuration to the open configuration.

14. The valve assembly of claim 13, further comprising a resilient device, wherein seating of the valve closure member in the second seat leads to a build-up of fluid pressure uphole of the second seat which overcomes the force of the resilient device biasing the control sleeve into the closed configuration, such that the control sleeve is urged axially under the fluid pressure relative to the outlet port from the closed configuration into the open configuration in which the outlet port is at least partially in fluid communication with the bore.

15. The valve assembly of claim 1, further comprising an outlet sleeve that is fixed in the bore of the body over the outlet port in the body, wherein the outlet sleeve comprises a leading edge formation at an uphole end of the outlet sleeve, formed as a radially inwardly extending shoulder having a throat that narrows to a diameter at a downhole end of the shoulder that is at least as narrow as an inner diameter of a bore of the control sleeve.

16. The valve assembly of claim 1, further comprising a shoulder extending radially into the bore above the first and second seats.

17. The valve assembly of claim 16, wherein the shoulder has a maximum diameter at an uphole end of the shoulder, and tapers to a narrower diameter towards a downhole end of the shoulder.

18. The valve assembly of claim 1, wherein the bore is adapted to receive the valve closure member and a second valve closure member, wherein the second valve closure member is inserted into the bore after the valve closure member is retained in the second seat and wherein the fluid outlet conduit is adapted to be obstructed by the second valve closure member, and wherein build-up of fluid pressure within the bore above the second valve closure member to the second fluid pressure threshold is adapted to force the valve closure member and the second valve closure member through the first and second seats.

19. A method of diverting fluid flow in a wellbore of a well, the method comprising:

flowing fluid through a valve assembly having a body comprising a bore with an axis, a control sleeve which is axially movable within the bore relative to an outlet port provided in the body between open and closed configurations of the control sleeve to open and close fluid communication between the outlet port and the bore, and first and second seats disposed in the control sleeve, the bore being in fluid communication with the wellbore, wherein the first seat is adapted to resiliently deform from a first resting configuration to a second deformed configuration of the first seat to allow passage of a valve closure member past the first seat at a first threshold pressure of fluid acting on the valve closure member seated on the first seat, and wherein the second seat is adapted to resiliently deform from a first resting configuration to a second deformed configuration of the second seat to allow passage of the valve closure member past the second seat at a second threshold pressure of fluid acting on the valve closure member seated on the second seat, wherein the second threshold pressure is higher than the first threshold pressure;

admitting the valve closure member into the bore of the body and seating the valve closure member on the first seat;

raising fluid pressure acting on the seated valve closure member on the first seat to the first threshold pressure to move the valve closure member past the first seat and seating the valve closure member on the second seat;

raising the pressure acting on the seated valve closure member on the second seat to an activation pressure between the first and second threshold pressures and diverting the fluid flowing in the bore through a fluid outlet in communication with the bore and disposed between the first and second seats;

retaining the valve closure member between the first and second seats during activation; and raising the pressure above the seated valve closure member on the second seat to the second threshold pressure to move the seated valve closure member through the second seat to open the bore of the valve assembly.

20. The method of claim 19, further comprising:

obturating the bore of the valve assembly by seating the valve closure member on the second seat; and actuating the valve assembly from a first configuration in which fluid flow is directed axially through the bore, to a second configuration in which fluid flow is directed radially through at least one outlet port disposed in a side wall of the valve assembly.

21. The method of claim 20 wherein the control sleeve is biased resiliently against the direction of fluid flow through the bore of the valve assembly by a resilient device, and wherein the method further comprises building fluid pressure uphole of the valve assembly when the bore is obturated by the valve closure member to urge the control sleeve in a downhole direction against the biasing force of the resilient device.

22. The method of claim 19, further comprising inserting a second valve closure member into the bore and seating the second valve closure member on the first seat to close off communication between the bore and the fluid outlet.

23. The method of claim 19, further comprising increasing the fluid pressure in the bore until it reaches the second threshold pressure, and forcing the valve closure member through the second seat.

24. The method of claim 19, further comprising returning the valve assembly to a closed configuration in which fluid travels in an axial direction through the bore by expansion of a resilient device.

25. The method of claim 19, further comprising reducing downward thrust acting on one of the first and second seats by restricting fluid flow through the bore axially uphole of one of the first and second seats.

26. A valve assembly for use in a wellbore of a well, the valve assembly comprising:

a body with a bore for flow of fluid through the valve assembly, the bore having an axis;

a valve closure member;

first and second resiliently deformable seats axially spaced from one another in the bore and each adapted to seat the valve closure member in the bore, to resist the passage of fluid through the bore past the seated valve closure member;

a resilient device; and a control sleeve having an outlet aperture, the first and second seats being axially spaced from one another on the control sleeve and disposed on opposite sides of the outlet aperture, the control sleeve biased resiliently against the direction of fluid flow through the bore of the valve assembly by the resilient device, and the control sleeve further being axially movable within the bore relative to an outlet port provided in the body between open and closed configurations of the control sleeve to open and close fluid communication between the outlet port and the bore, wherein the first seat is adapted to resiliently deform from a first resting configuration to a second deformed configuration of the first seat to allow passage of the valve closure member past the first seat at a first threshold pressure of fluid acting on the valve closure member seated on the first seat, wherein the second seat is adapted to resiliently deform from a first resting configuration to a second deformed configuration of the second seat to allow passage of the valve closure member past the second seat at a second threshold pressure of fluid acting on the valve closure member seated on the second seat, wherein the second threshold pressure is higher than the first threshold pressure, and wherein seating of the valve closure member in the second seat leads to a build-up of fluid pressure uphole of the second seat which overcomes the force of the resilient device biasing the control sleeve, such that the control sleeve is urged axially under the fluid pressure relative to the outlet port from the closed configuration into the open configuration in which the outlet port is at least partially in fluid communication with the bore.

* * * * *